US005153656A

United States Patent [19]

Johnson et al.

[11] Patent Number: 5,153,656

[45] Date of Patent: Oct. 6, 1992

[54] IMAGE FORMING APPARATUS INCLUDING TRANSFER AND FIXING MEMBER

[75] Inventors: Kevin M. Johnson; Thomas C. Merle, both of Rochester, N.Y.

[73] Assignee: Eastman Kodak Company, Rochester, N.Y.

[21] Appl. No.: 783,476

[22] Filed: Oct. 28, 1991

[51] Int. Cl.[5] ..... G03G 15/20

[52] U.S. Cl. ..... 355/290; 355/285; 355/326; 355/271; 430/124; 219/216

[58] Field of Search ..... 355/290, 289, 285, 326, 355/282, 271, 272; 430/124, 33; 118/59, 60; 219/216, 388; 432/60

[56] References Cited

U.S. PATENT DOCUMENTS 3,948,215 4/1976 Namiki .
4,927,727 5/1990 Rimai et al. .
4,931,618 6/1990 Nagata et al. ..... 219/216
4,968,578 11/1990 Light et al. .
4,992,833 2/1991 Derimiggio .
5,021,835 6/1991 Johnson .
5,023,038 6/1991 Aslam et al. .
5,085,962 2/1992 Aslam et al. ..... 430/99

FOREIGN PATENT DOCUMENTS 0295901 12/1988 European Pat. Off. .
0301585 2/1989 European Pat. Off. .

OTHER PUBLICATIONS

English Abstract of Japanese Kokai Patent 1-179181, publishing date of Patent Jul. 17, 1989.

*Primary Examiner*—Richard L. Moses
*Attorney, Agent, or Firm*—Leonard W. Treash

[57] ABSTRACT

A toner image, for example, a multicolor toner image, is transferred to a receiving sheet carried by a heated transfer drum. The multicolor image is fixed by pressure between a fusing web or sheet and the toner image exerted by a heated pressure roller and the transfer drum. The fusing web or sheet and the receiving sheet are transported away from the transfer drum and pressure roller to cool, after which they are separated.

14 Claims, 4 Drawing Sheets

IMAGE FORMING APPARATUS INCLUDING TRANSFER AND FIXING MEMBER

RELATED APPLICATION

This application is related to co-assigned U.S. patent Application Ser. No. 783475, filed Oct. 28, 1991, in the names of Kevin M. Johnson and Thomas C. Merle, entitled IMAGE FORMING APPARATUS INCLUDING TONER IMAGE FIXING DEVICE USING FUSING SHEETS.

TECHNICAL FIELD

This invention relates to the fixing of toner images to receiving sheets and, more particularly to a type of fixing in which a heated toner image is pressed between its receiving sheet and a hard surface. Although not limited thereto, it is particularly useful in fixing high-quality multicolor toner images which have been transferred to the receiving sheet at an elevated temperature.

BACKGROUND ART

U.S. Pat. No. 4,968,578, Light et al issued Nov. 6, 1990; U.S. Pat. No. 4,927,727, Rimai et al, issued May 22, 1990; and U.S. Pat. No. 5,021,835, Johnson, issued Jun. 4, 1991, all describe a heat-assisted toner image transfer method. Two or more single color images are transferred in registration from an image member to a receiving sheet by heating the receiving sheet to an elevated temperature. The temperature of the receiving sheet is sufficiently above the softening point of the toner that the toner sticks to the receiving sheet. Preferably, the receiving sheet is heated from inside a transfer drum to which it is secured. The transfer drum and image member form a pressure nip with the combination of heat and pressure transferring the image. This method is particularly useful in transferring extremely small, dry toner particles, for example, toner particles having a mean particle diameter of 8 microns or less.

Especially in transferring a series of single color toner images to form a multicolor toner image, the layers of toner pile up above the level of the receiving sheet even when substantial pressure is used in transfer. This results in an unacceptable relief image corresponding generally to the optical density of the image. U.S. Pat. No. 5,023,038 to Aslam et al issued Jun. 11, 1991 and U.S. patent application Ser. No. 07/405,258 to Rimai et al describe a method of fixing such toner images to a receiving sheet which receiving sheet has an outer heat-softenable thermoplastic layer. The relief image is substantially reduced, the image is more permanently fixed and gloss can be increased by bringing the image into contact with a ferrotyping surface under conditions of heat and pressure which cause the image to be further embedded in the thermoplastic layer. The ferrotyping surface is smooth and hard and has food release characteristics. For example, it can be made of nickel, stainless steel or other metals, with or without surface treating with silicones or the like. As disclosed in those references, the ferrotyping surface can also be textured to provide a matte or other textured finish to the image.

In designing a continuous production image forming apparatus, the ferrotyping surface is formed on a web. The web is usually in the form of an endless belt, but it can also be quite long and have supply and take-up rolls for continuous operation. For purposes herein, the term "web" shall include but not be limited to an endless belt.

The use of endless belts generally to fix regular toner images to paper, transparency stock, or the like, has been known for many years; see, for example, U.S. Pat. No. 3,948,215; European applications Nos. 0301585 and 0295901.

Japanese Kokai 1-179181; laid open Jul. 17, 1989 (Appl. No. 63-2288) shows a transfer drum for holding a receiving sheet. An internally heated fusing roller contacts the image after transfer to fix the image before it leaves the transfer drum.

U.S. Pat. No. 4,992,833, Derimiggio, issued Feb. 12, 1991, shows the use of individual sheets for receiving a toner image to which the image is fused before transfer to a receiving sheet. The intermediate and receiving sheet are maintained in contact until cool before separating.

Typically, in most of the above fixing processes the toner image is left in contact with the web until the image is cooled below the glass transition temperature of the toner, at which point the receiving sheet can be separated without offset. In the processes using a thermoplastic layer for receiving the image, that layer also is cooled to below its softening point before separation. Preventing offset by cooling in contact with the web eliminates the need for offset preventing liquids which have a degrading effect on a high quality image.

A problem in using a web system, especially an endless belt system in a productive image forming apparatus is associated with the time required for the belt and image to cool while maintained in contact. If the fixing device is slowed down to below the speed of the transfer station to allow cooling, then the mismatch of speeds between the transfer station and the fixing device must be accommodated. In general, this requires either a full frame distance in the in-track direction between the transfer station or drum and the fixing device, or a loop or other mechanism for absorbing the difference in speeds.

DISCLOSURE OF THE INVENTION

It is an object of this invention to provide an image forming apparatus in which a hard fusing surface contacts a toner image to be fixed under appropriate conditions of heat and pressure, but in which many of the problems associated with the distance between the fixing and transfer functions in the apparatus are eliminated or lessened.

This and other objects are accomplished by an apparatus including a transfer member and means for securing a receiving sheet to it. One or more toner images are transferred to a receiving sheet while secured to the transfer member. A fusing web or sheet having a hard fusing surface is brought into contact with the receiving sheet with the fusing surface contacting the toner image. A heating means heats the toner image to or above its softening temperature. A force is applied urging the fusing surface against the heated toner image while the receiving sheet is backed by the transfer member, with sufficient pressure to fix the toner image to the receiving sheet. The receiving sheet is moved away from the heating means while in contact with the fusing web or sheet permitting the toner image to cool below its softening temperature and is then separated from the fusing web or sheet.

According to a preferred embodiment, a series of different color toner images are transferred to a receiving sheet which may have a heat-softenable outer layer while that receiving sheet is backed by a heated transfer member, for example, a heated transfer drum. With this embodiment, heat-assisted transfer and heat-assisted pressure fixing are done on the same heated transfer member, thereby reducing loss of heat between the two functions.

According to a further preferred embodiment, the fusing surface is a surface of a fusing sheet having a finite length which is fed from a fusing sheet supply. In this embodiment, the pressure is applied by a backing roller which forms a nip with the transfer member and moves at the same speed as the transfer member. However, the receiving sheet and fusing sheet form a sandwich. They cool together while stopped or moving at a slower speed than the transfer member thereby shortening the size of the apparatus.

DISCLOSURE OF THE PREFERRED EMBODIMENTS

Figure 1:
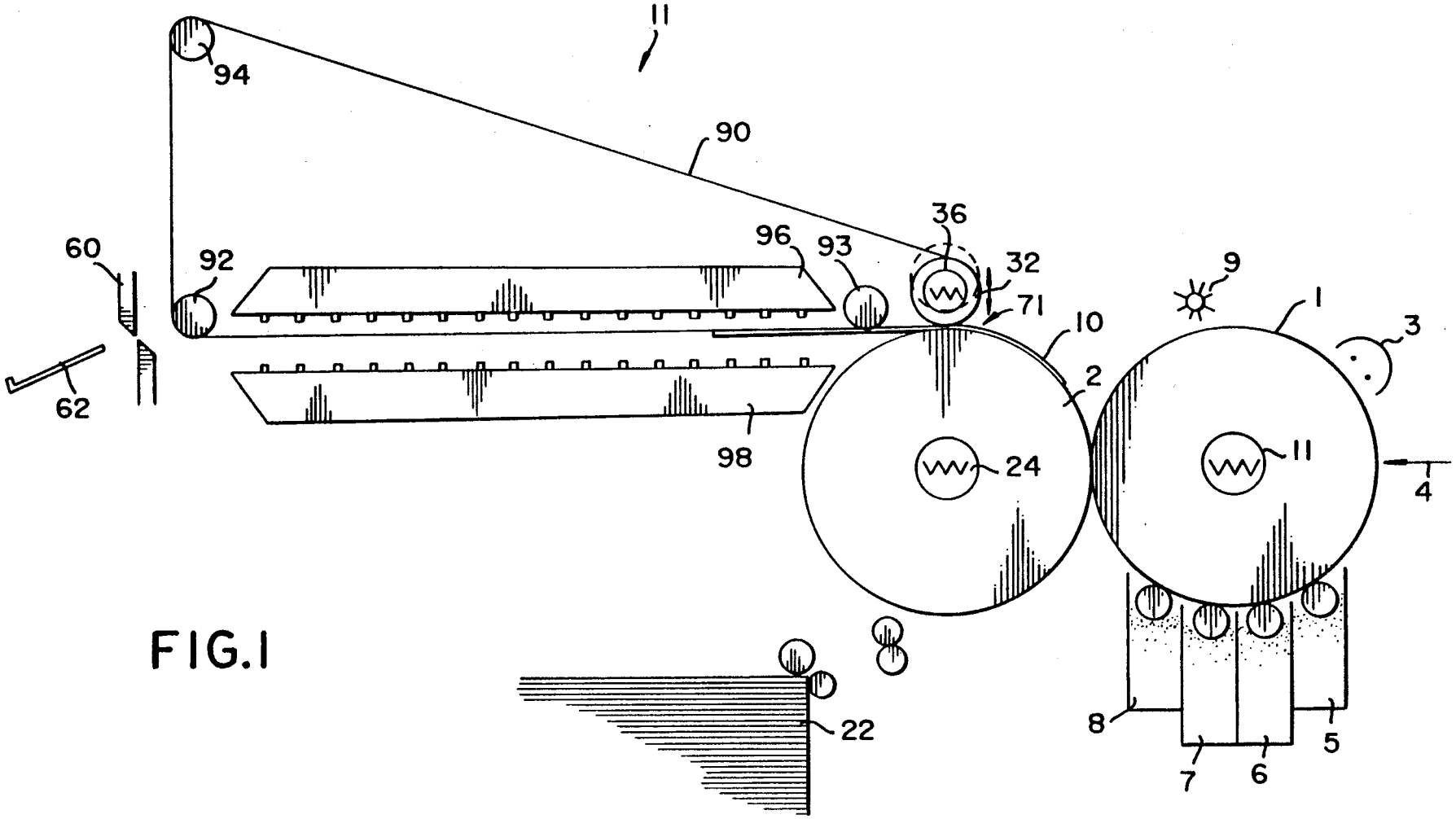
FIG. 1 is a side schematic of an image forming apparatus constructed according to the invention.

According to FIG. 1 an image forming apparatus includes an image member, for example, a photoconductive drum 1. Photoconductive drum 1 is uniformly charged by a charging station 3 and imagewise exposed at an exposure station, for example, a laser exposing device 4 to create a series of electrostatic images. The series of electrostatic images are each toned by a different one of toner stations 5, 6, 7 and 8 to create a series of different color, single color toner images.

A receiving sheet is fed from a receiving sheet supply 22 onto the periphery of a transfer drum 2 where it is held by gripping fingers, vacuum, electrostatics or other means well known in the art. Transfer drum 2 is rotated at the same peripheral speed as image member 1 and cycles an outside surface of receiving sheet 10 through transfer relation with the series of toner images created on drum 1. The toner images are transferred to the outside surface of receiving sheet 10 in registration to create a multicolor image thereon.

For highest quality images, the transfer of the toner image is accomplished by heating the receiving sheet 10 to a temperature at which the receiving sheet raises the temperature of the toner to a point that the toner sinters at least where it contacts other toner and attaches itself to the surface of the receiving sheet. See U.S. Pat. Nos. 4,968,578; 4,927,727; and 5,021,835, referred to above, for more details on such a heat-assisted transfer method. The heat for such transfer is provided predominantly by an internal heating lamp 24 located inside transfer drum 2. It may also be assisted by an internal heating lamp 11 located inside photoconductive drum 1, which lamp heats the photoconductive drum somewhat above ambient but not sufficiently above it to destroy its photoconductive properties or cause the toner to stick to photoconductive drum 1.

Although this transfer process can be used to transfer toner to plain paper or other similar stock, it is most efficient and the highest quality images are obtained if the receiving sheet 10 has a heat-softenable thermoplastic outside layer. The outside layer is softened by the heated transfer drum encouraging the toner to embed in it assisting in the transfer of at least the first layer. Subsequent layers of toner are transferred by adherence of the toner particles to each other as they are softened at least where they touch. This process can be assisted by an electrical field applied by a suitable means, not shown. Drum 1 is continuously cleaned by cleaning station 9, as is well known in the art.

Transfer drum 2 can be a hard metallic drum which effectively transfers the energy from lamp 24 to receiving sheet 10. A typical temperature for transfer drum 2 is 100 degrees C. The receiving sheet 10 is also raised to approximately this temperature, especially in the course of recycling to pick up three or four toner images.

After the multicolor image has been formed on transfer sheet 10, it is fixed by fixing device 11. Fixing device 11 includes a series of rollers 32, 92, 93 and 94 about which is entrained a ferrotyping belt 90. Ferrotyping belt or web 90 is known in the art and can be formed of any of the materials disclosed in U.S. Pat. No. 5,023,038 cited above, which patent is incorporated by reference herein. For example, ferrotyping belt 90 can be stainless steel or nickel and can have a silicone surface treatment to resist offset. It can be hard and smooth to impart a glossy appearance to the final image or it can be hard and textured to provide a matte or silk finish to the image.

Roller 32 is internally heated by a lamp 36 and is articulatable from a position in which ferrotyping belt 90 is out of contact with drum 2 and receiving sheet 10 to a position in which roller 32 urges the fusing surface of ferrotyping belt 90 into contact with an image on receiving sheet 10 while receiving sheet 10 is backed by transfer drum 2. Belt 90 forms a nip 71 with drum 2 only when receiving sheet 10 is in the nip. Roller 32 urges the fusing surface of belt 90 into contact with the toner image with enough force to provide sufficient pressure to fix the image on receiving sheet 10 and apply the glossy or textured surface treatment desired. This pressure can be as low as 100 pounds per square inch to higher than 1,000 pounds per square inch. If lamp 24 has heated the toner image and any thermoplastic layer in which it is partially embedded to a high enough temperature, it may not be necessary to internally heat roller 32. However, it is generally desirable to internally heat roller 32 to prevent that roller from cooling the image below its softening temperature, especially because roller 32 is not in contact with drum 2 except when the receiving sheet 10 is in nip 71.

As the receiving sheet leaves nip 71 it sticks to the fusing surface of belt 90 and follows belt 90 away from heating lamps 24 and 36. This permits the toner image and any thermoplastic layer of the receiving sheet to cool below its glass transition temperature allowing separation at small roller 92 without offset of either the toner image or any thermoplastic layer onto the fusing surface of belt 90. The process of cooling the toner image and any thermoplastic layer can be assisted by air cooling devices 96 and 98 located on opposite sides of belt 90 as belt 90 moves away from nip 71. After separation of the receiving sheet 10 from belt 90, the receiving sheet is transported on for further processing. It can be cut into smaller sheets by slitter and chopper 60 and ultimately fed to an output tray 62.

The fixing device 11 has the substantial advantage of cooperating with the transfer drum 2 which has already heated receiving sheet 10 for the purposes of transfer. Thus, little or no heat is lost between the transfer and fixing steps. However, because the fixing must be accomplished at the same speed as transfer, web 90 must be sufficiently long to allow the image to cool before separation at roller 92. This problem can be obviated by the embodiment shown in FIG. 2.

Figure 2:
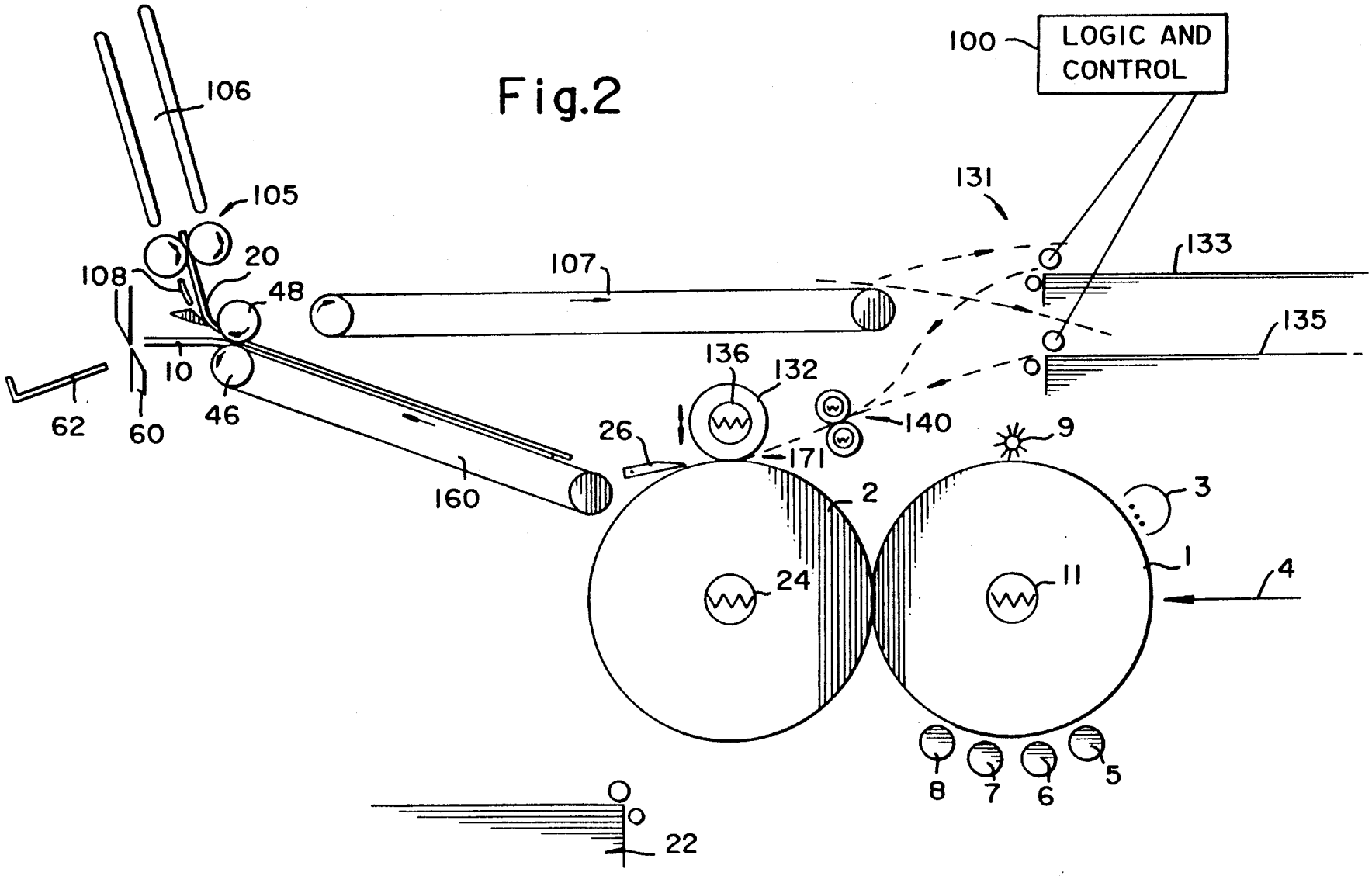
FIG. 2 is a side schematic of an alternative form of an image forming apparatus constructed according to the invention.

According to FIG. 2, toner images are formed on image member 1 in the same way as in FIG. 1 and transferred to a receiving sheet 10 held to a transfer drum 2 also as in FIG. 1. However, instead of an endless ferrotyping web 90, a separate, finite length fusing sheet 20 is fed from a fusing sheet supply 131 into a nip 171 formed by a heated roller 132 and transfer drum 2. Roller 132 is heated by an internal lamp 136, and fusing sheet 20 is fed from fusing sheet supply 131 through a pair of heated rollers 140 which bring the fusing sheet up toward the temperature of drum 2 and roller 132. Fixing roller 132 is articulated toward transfer drum 2 as fusing sheet 20 and receiving sheet 10 enter nip 171. To assist in ultimate separation of the fusing sheet and the transfer sheet, it is preferable that the fusing sheet slightly lead the transfer sheet into nip 171. Preferably, fixing roller 132 is moved into pressure applying engagement with the fusing and receiving sheets in nip 171 as the receiving sheet 10 enters the nip and slightly after fusing sheet 20 has entered the nip to form a sandwich. The sandwich is separated from drum 2 by a pawl 26.

A transport device 160 transports the sandwich after separation away from heated transfer drum 2 and heated roller 132. While the sandwich is transported by transport device 160 it can be cooled by a suitable air cooling mechanism similar to that shown in FIG. 1. The fusing sheet is separated from the receiving sheet at separation rollers 46 and 48 and the receiving sheet 10 continues on to slitter and chopper 60 and output hopper 62 as in the FIG. 1 structure. Separation of the fusing sheet and receiving sheet will be described with respect to FIGS. 3 and 4 below. The fusing sheet is fed onto a pair of reversible rollers 105 which drive it into a turnaround area 106 until the trailing edge of fusing sheet 20 passes separation roller 48. At this point, the rollers 105 are reversed in direction and a guide 108 is moved into a position to guide the fusing sheet onto a fusing sheet transport 107 which transports the fusing sheet back to fusing sheet supply 131.

Fusing sheet supply 131 can have two sub-supplies 133 and 135 which contain different types of fusing sheets to impart different surface treatments to the image as controlled by a logic and control 100. This allows pushbutton operator choice of glossy, matte, silk or other finishes to the final image. With the structure shown in FIG. 2, actual fixing can be carried out at full transfer drum speed by transfer drum 2 and roller 132 which provide sufficient pressure between the fusing surface of the fusing sheet 20 and the image to fix the image to the receiving sheet. The sandwich can be cooled while travelling at a slower speed on transport 160 thereby shortening the size of the apparatus substantially. Note that transport device 160 can be stopped once the sandwich has passed far enough away from the heated transfer drum 2 and roller 132 to permit it to cool. It can be started again when a new sandwich is being fed to it. The sandwiches also could be stacked on the top of transport 160 and fed off the bottom after a suitable delay for cooling. In addition to the advantages of compactness and choice of textures provided by the fusing sheets as compared with the endless ferrotyping web or belt shown in FIG. 1, the image forming device shown in FIG. 2, by eliminating the belt, has eliminated many other problems. Web-tracking devices are not required. The problems associated with timing the seam of a belt are eliminated and the problems of changing a damaged or worn out belt or belt having the wrong texture are also eliminated. Belts have very limited room inside them for cooling structure. This problem is also eliminated with fusing sheets.

Figure 4:
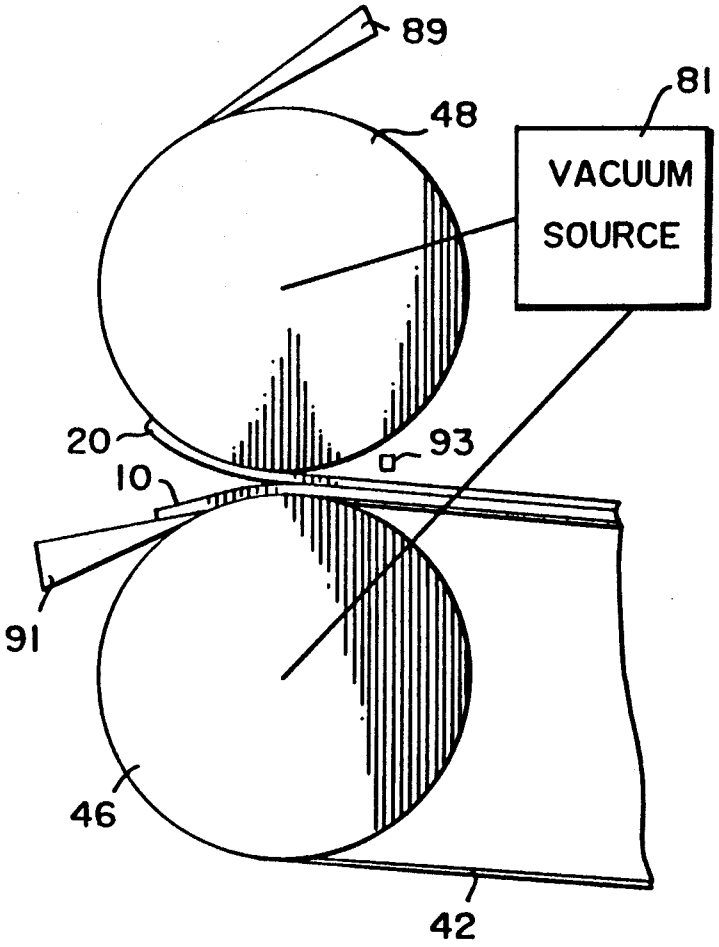
FIGS. 3–6 are side schematics of alternative embodiments of a separation device usable with the embodiment shown in FIG. 2.
Figure 3:
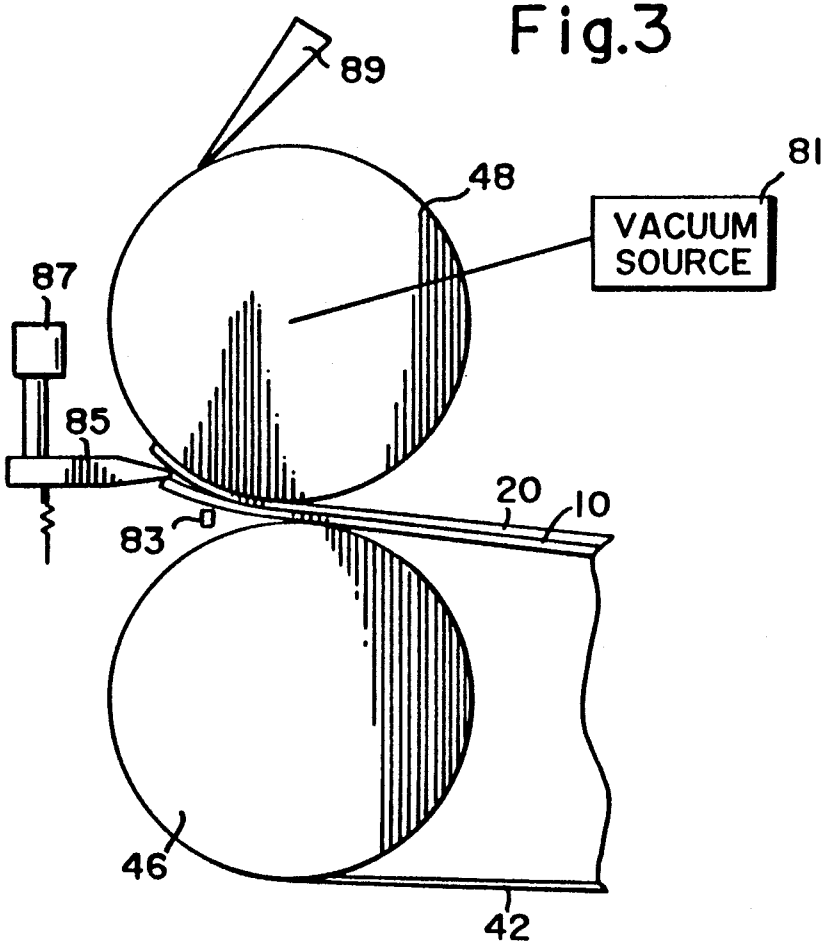

Separation of the fusing sheet from the receiving sheet by separation rollers 46 and 48 can be performed in a number of ways. FIGS. 3 and 4 illustrate two different approaches to separating these sheets. As mentioned above, the fusing sheet is fed into nip 171 slightly ahead of the receiving sheet. The fusing sheet leading edge thus overlaps the leading edge of the receiving sheet slightly. FIG. 3 illustrates use of this aspect in separating the sheets. According to FIG. 3 separation roller 48 is positioned slightly downstream from separation roller 46. A vacuum source 81 is connected to ports in separation roller 48 in at least the portion of roller 48 that initially touches fusing sheet 20 as fusing sheet 20 and receiving sheet 10 leave transport device 160. A vacuum applied internally to separation roller 48 causes the fusing sheet to adhere to separation roller 48 and begin to travel around separation roller 48 as it moves in a clockwise direction. The toner image (and thermoplastic layer, if any) are below their glass transistion temperatures. If the receiving sheet 10 is relatively thick, its beam strength will cause it to separate from fusing sheet 20 and it will be fed below a pawl or skive 85. Alternatively, receiving sheet 10 can be held to separation roller 46 through transport device 160 and the beam strength of fusing sheet 20 used to separate the sheets. This has the advantage of using a likely greater beam strength of fusing sheet 20, but the disadvantage of preferring overlapping the receiving sheet beyond the fusing sheet leading edge.

If the beam strength of receiving sheet 10 is not enough to separate the sheets, receiving sheet 10 follows receiving sheet 20 which is held to separation roller 48 by the vacuum source 81. An optical sensor 83 senses the arrival of the leading edge of the sandwich, that is, the leading edge of fusing sheet 20. It triggers actuation of a solenoid 87 which pivots separation skive 85 into contact with the portion of the fusing surface of fusing sheet 20 which extends beyond the leading edge of receiving sheet 10. The separation skive then separates the two sheets as they are driven forward by transport 160 with the fusing sheet following separation roller 48 and the transfer sheet going below separation skive 85 toward slitter and chopper 60 (FIG. 2).

FIG. 4 illustrates an alternative device for separating the receiving sheet and the fusing sheet. According to FIG. 4 both separation rollers 46 and 48 are connected to the vacuum source 81. A vacuum applied to vacuum openings in separation roller 46 grips receiving sheet 10 through transport device 42 while the vacuum applied through openings in separation roller 48 grips fusing sheet 20 thereby pulling the two sheets apart. Fusing sheet 20 is allowed to continue to follow separation roller 48 and is held by the vacuum until it is skived by a remote skive 89 for return to the fusing sheet supply. Receiving sheet 10 is skived from separation roller 46 by a skive 91 after it has progressed sufficiently that it will not return into contact with fusing sheet 20. To assure maintenance of such separation, an additional guide, not shown, can be placed to fit between the sheets as they separate. A leading edge sensor 93 is positioned in advance of the separation rollers 46 and 48 and can be used (in both FIGS. 3 and 4) to control timing in the application of the vacuum to rollers 46 and 48. Note that in this embodiment the fusing sheet 20 has not been positioned to overlap the receiving sheet 10, since that aspect is not used in providing separation as it is with the FIG. 3 structure.

Figure 6:
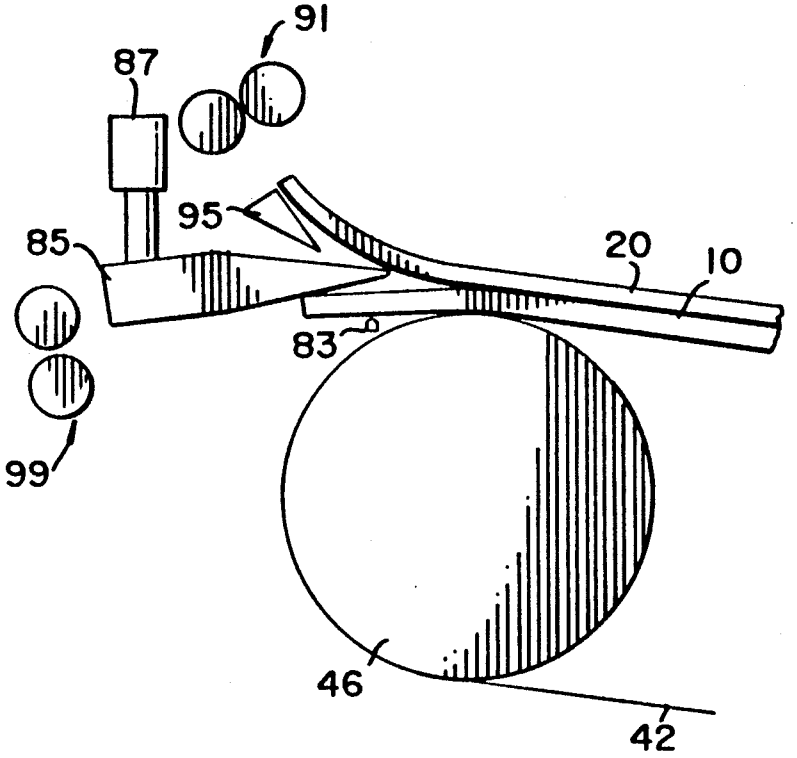
Figure 5:
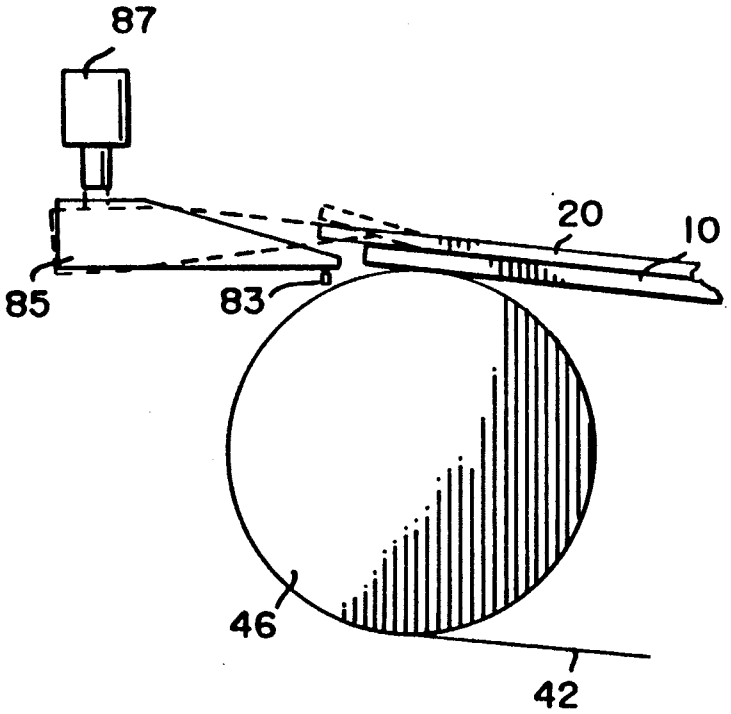

FIGS. 5 and 6 illustrate a preferred separating embodiment particularly suitable with fusing sheets and receiving sheets of substantial beam strength. It is similar to the FIG. 3 embodiment except that vacuum separation roller 48 is eliminated and the beam strength or stiffness of the sheets is used to separate the sheets. According to FIG. 5, the sheets 10 and 20 separate from belt 42 as it moves around roller 46. Roller 46 can be as small as necessary to provide such separation. When the leading edge of fusing sheet 20 is sensed by sensor 83, solenoid 87 is triggered and pawl or skive 85 is rotated to raise the leaded portion of sheet 20 as shown in phantom in FIG. 5. The beam strength of the two sheets causes them to separate and they travel on opposite sides of pawl 85, as shown in FIG. 6. Receiving sheet 10 moves to roller 99 and on for further treating, cutting, or the like, while fusing sheet 20 moves rollers 91 (or 105) to begin its return to the fusing sheet supply.

Note that in both FIGS. 1 and 2, the receiving sheet goes through only one heating and cooling cycle, the single heating cycle spans both transfer and fixing and the cooling cycle occurs only after fixing. Virtually no heat is lost between transfer and fixing.

The invention has been described particularly with respect to receiving sheets that have a heat-softenable thermoplastic outer layer in which toner is embedded. It is particularly well suited for application to such receiving sheets. However, it can be used with other receiving sheets not having this feature, for example, ordinary or specially treated paper or transparency stock.

The invention is useful in fixing single color images, but will have its best application in multicolor image formation because of its special applicability to reducing the relief image created in superposing a series of single color dry toner images.

The invention has been described in detail with particular reference to a preferred embodiment thereof, but it will be understood that variations and modifications can be effected within the spirit and scope of the invention as described hereinabove and as defined in the appended claims.

We Claim:

1. An image forming apparatus, comprising:

means for forming a toner image on an image member, a transfer member, means for securing a receiving sheet to the transfer member, means for transferring the toner image to the receiving sheet while said receiving sheet is secured to the transfer member, a fusing web or sheet having a hard fusing surface, means for contacting the receiving sheet and fusing web or sheet, with said fusing surface contacting the toner image, means for heating said toner image to or above its softening temperature, means for applying a force urging the fusing surface against said heated toner image while said receiving sheet is secured to or backed by said transfer member, with sufficient pressure to fix said toner image to said receiving sheet, means for transporting said receiving sheet away from said heating means while in contact with said fusing surface permitting said toner image to cool below its softening temperature, and means for separating said receiving sheet and said fusing surface after said toner image is cooled below its softening temperature

2. An image forming apparatus according to claim 1 further including means for heating said transfer member sufficiently to heat said receiving sheet to a temperature above the softening point of said toner image during both transfer and mixing of the toner image.

3. An image forming apparatus according to claim 2 wherein said transfer member is an internally heated drum.

4. An image forming apparatus according to claim 1 wherein said fusing surface is hard and smooth and provides a glossy surface treatment to said toner image.

5. An image forming apparatus according to claim 1 wherein said fusing web or sheet is an endless belt entrained about a plurality of rollers, one of said rollers being said urging means and being internally heated.

6. An image forming apparatus according to claim 1 wherein said fusing web or sheet is a fusing sheet having a finite length and said apparatus includes:

a supply holding at least one such fusing sheet, means for feeding a fusing sheet from said supply into contact with said receiving sheet, means for heating said fusing sheet prior to contact with said receiving sheet, and means for returning said fusing sheet to said supply after said fusing sheet has been separated from said receiving sheet.

7. An image forming apparatus comprising means for forming a series of different color, single color, dry toner images on an image member, a transfer drum, means for securing a receiving sheet to the transfer drum, means for heating said transfer drum to a temperature sufficient to raise the temperature of a secured receiving sheet to a temperature above the softening point of the toner images, means for bringing the image member and the receiving sheet when backed by the transfer member into pressure contact to transfer said toner images in registration to the receiving sheet to form a multicolor image thereon, a fusing web or sheet having a hard fusing surface, means for contacting the receiving sheet with the fusing web or sheet, with the fusing surface in contact with the toner image, means for heating said toner image to or above its softening temperature while said toner image is in contact with said fusing surface, means for applying a force urging the fusing surface against said heated toner image while said receiving sheet is backed by said transfer drum, with sufficient pressure to fix said toner image to said receiving sheet, means for feeding said receiving sheet away from said heating means while in contact with said fusing surface, permitting said toner image to cool below its softening temperature, and means for separating said receiving sheet and said fusing surface after said toner image is cooled below its softening temperature.

8. An image forming apparatus, comprising:

means for forming a series of different color toner images on an image member, a transfer drum, means for securing a receiving sheet to the periphery of the transfer drum, said receiving sheet having a heat-softenable outer layer, means for heating the transfer drum to a temperature sufficient to raise the temperature of the receiving sheet above the heat-softening temperature of the thermoplastic layer and of the toner images, means for transferring the toner images one after another to the heat-softenable layer of the receiving sheet while the receiving sheet is secured to the transfer drum and while the receiving sheet is at said heated temperature, to partially embed the toner image in the heat-softenable layer, creating a multicolor toner image, a fusing web or sheet having a hard fusing surface, means for contacting the fusing surface and the heat-softenable layer of the receiving sheet containing the multicolor toner, means for heating the multicolor toner image and the heat-softenable layer to a temperature above their softening temperatures while the multicolor toner image and heat-softenable layer are in contact with the fusing surface, means for applying a force urging the fusing sheet against the heated multicolor toner image and heat-softenable layer while said receiving sheet is backed by said transfer drum, with sufficient pressure to fix said multicolor toner image to said receiving sheet, and further embed the multicolor toner image in said heat-softenable layer, means for transporting the receiving sheet away from said transfer drum while in contact with said fusing surface, permitting said multicolor toner image and heat-softenable layer to cool below their softening temperatures, and means for separating said receiving sheet and said fusing surface after said multicolor toner image and heat-softenable layer have cooled below their softening temperatures.

9. An image forming apparatus according to claim 8 wherein said fusing web or surface is a fusing sheet having a finite length and said apparatus includes:

a supply holding at least one such fusing sheet, means for feeding a fusing sheet from said supply into contact with said receiving sheet, and means for returning said fusing sheet to said supply after said receiving sheet has been separated from said fusing surface.

10. An image forming apparatus according to claim 8 wherein said fusing surface is hard and smooth and provides a glossy surface treatment to said toner image.

11. An image forming apparatus according to claim 9 wherein said fusing surface is hard and smooth and provides a glossy surface treatment to said toner image.

12. An image forming apparatus according to claim 8 wherein said means for heating said transfer drum is located inside said transfer drum and said transfer drum is a hard, metallic drum having a metallic outer surface contacting said receiving sheet.

13. An image forming method comprising:

forming a series of different color toner images on an image member, transferring said toner images in registration to a receiving sheet supported on the periphery of a heated transfer drum to form a multicolor image on said sheet, feeding a fusing sheet having a finite length from a supply of such fusing sheets into overlying relation with said multicolor image on said receiving sheet, supplying sufficient heat and pressure to said fusing sheet and receiving sheet to fix the multicolor toner image to said receiving sheet, while said receiving sheet is backed by said transfer drum, transporting said receiving sheet and fusing sheet away from said transfer drum and allowing said toner image to cool while still in contact with said fusing sheet, and separating said fusing sheet and receiving sheet after said toner image is sufficiently cool that it does not offset onto said fusing sheet when separated.

14. The method according to claim 13 wherein said receiving sheet has a heat-softenable layer and said transfer step includes heating said layer to its softening point and at least partially embedding said toner images in said layer, and wherein said fixing step includes further embedding said toner image in said heat-softenable layer.

* * * * *